US009635907B2

(12) United States Patent
Romero et al.

(10) Patent No.: US 9,635,907 B2
(45) Date of Patent: May 2, 2017

(54) SYSTEM AND METHOD FOR PRINTING CUSTOMIZED GRAPHICS ON FOOTWEAR AND OTHER ARTICLES OF CLOTHING

(71) Applicant: Pics on Kicks, LLC, Venice, CA (US)

(72) Inventors: Nick Romero, Venice, CA (US); Fernando Padilla, Santa Fe Springs, CA (US)

(73) Assignee: Pics on Kicks, LLC, Los Angeles, CA (US)

( * ) Notice: Subject to any disclaimer, the term of this patent is extended or adjusted under 35 U.S.C. 154(b) by 539 days.

(21) Appl. No.: 14/338,206

(22) Filed: Jul. 22, 2014

(65) Prior Publication Data

US 2014/0331417 A1 Nov. 13, 2014

Related U.S. Application Data

(60) Division of application No. 13/549,235, filed on Jul. 13, 2012, now Pat. No. 8,784,939, which is a continuation of application No. 13/549,168, filed on Jul. 13, 2012, now Pat. No. 8,568,829.

(60) Provisional application No. 61/507,565, filed on Jul. 13, 2011.

(51) Int. Cl.

| | |
|---|---|
| ***B25B 9/00*** | (2006.01) |
| ***A43D 5/02*** | (2006.01) |
| ***A43D 8/22*** | (2006.01) |

(52) U.S. Cl.

CPC ..... *A43D 5/02* (2013.01); *A43D 8/22* (2013.01); *Y10S 269/90* (2013.01); *Y10S 269/909* (2013.01)

(58) Field of Classification Search

CPC . B23Q 1/03; B23Q 1/585; B23Q 1/74; B23Q 3/00; B23P 11/027

See application file for complete search history.

(56) References Cited

U.S. PATENT DOCUMENTS

| | | | |
|---|---|---|---|
| 1,969,972 | A | 8/1934 | Edwards |
| 3,168,753 | A | 2/1965 | Bass |
| 3,635,353 | A | 1/1972 | Matsubara |
| 4,037,640 | A | 7/1977 | Hubbard |
| 4,807,143 | A | 2/1989 | Matsuura |
| 5,090,320 | A | 2/1992 | Nave |
| 5,594,652 | A | 1/1997 | Penn et al. |
| 5,673,499 | A | 10/1997 | Attilieni |
| 5,930,810 | A | 7/1999 | Farros et al. |
| 6,095,628 | A | 8/2000 | Rhome |

(Continued)

FOREIGN PATENT DOCUMENTS

| | | |
|---|---|---|
| JP | 05293955 | 11/1993 |
| JP | 10195784 | 7/1998 |

(Continued)

OTHER PUBLICATIONS

Callan, F., European Search Report, EP 16150959, Aug. 11, 2016, 6 pages.

*Primary Examiner* — Lee D Wilson

(74) *Attorney, Agent, or Firm* — Todd R. Miller; Vested Law LLP

(57) ABSTRACT

A shoe platen to securely hold a shoe so that graphics, including custom graphics, can be printed on the shoe automatically. The platen comprises a shoe plate 102 configured to receive shoes such as high-top shoes or low top shoes. Adjusters 104, 106 can also be used to accommodate shoes of various styles and sizes.

20 Claims, 11 Drawing Sheets

(56) References Cited

U.S. PATENT DOCUMENTS

| | | | | |
|---|---|---|---|---|
| 6,299,962 | B1 | 10/2001 | Davis et al. | |
| 6,361,230 | B1 | 3/2002 | Crystal et al. | |
| 6,467,898 | B2 | 10/2002 | Codos et al. | |
| 6,533,885 | B2 | 3/2003 | Davis et al. | |
| 7,040,748 | B2 | 5/2006 | Nimi et al. | |
| 7,124,518 | B1 | 10/2006 | Brown | |
| 8,568,829 | B2 * | 10/2013 | Padilla | B41M 5/0047 101/126 |
| 8,784,939 | B2 * | 7/2014 | Romero | A43D 5/02 101/134.5 |
| 2002/0082953 | A1 | 6/2002 | Batham et al. | |
| 2002/0133261 | A1 | 9/2002 | Fard | |
| 2005/0071242 | A1 | 3/2005 | Allen et al. | |
| 2007/0043582 | A1 | 2/2007 | Peveto et al. | |
| 2008/0147219 | A1 | 6/2008 | Jones et al. | |
| 2009/0025123 | A1 | 1/2009 | Weedlun et al. | |
| 2011/0109686 | A1 | 5/2011 | McDowell et al. | |
| 2012/0175813 | A1 | 7/2012 | Leedy | |
| 2013/0014330 | A1 * | 1/2013 | Romero | A43D 5/02 12/123 |
| 2013/0017330 | A1 * | 1/2013 | Padilla | B41M 5/0047 427/256 |
| 2014/0331417 | A1 * | 11/2014 | Romero | A43D 5/02 12/123 |

FOREIGN PATENT DOCUMENTS

| | | |
|---|---|---|
| JP | 200315370 | 1/2003 |
| WO | WO98/38377 | 9/1998 |

* cited by examiner

SYSTEM AND METHOD FOR PRINTING CUSTOMIZED GRAPHICS ON FOOTWEAR AND OTHER ARTICLES OF CLOTHING

CROSS-REFERENCE TO RELATED APPLICATION

This patent application is a divisional application of U.S. patent application Ser. No. 13/549,235, filed Jul. 13, 2012, which is a continuation of U.S. patent application Ser. No. 13/549,168, filed Jul. 13, 2012, which claims the benefit of U.S. Provisional Patent Application No. 61/507,565, entitled "System and Method for Printing Customized Graphics on Shoes and Other Articles," filed Jul. 13, 2011, which applications are incorporated in their entirety here by this reference.

TECHNICAL FIELD

This invention relates to platens for holding shoes and other articles during printing of graphics on the shoe or other article.

BACKGROUND ART

Printing graphics on articles of clothing, such as shirts, is a relatively simple process due to the flat nature of the article of clothing during the printing process. Printing on shoes and caps, on the other hand poses unique challenges due to the 3-dimensionality of the article. In addition, with shoes, it is a further challenge to print on the tongue of the shoe, which tends to be encumbered by other portions of the shoe. Due to the increasing popularity of expressing one's creativity, persona, and individuality, the ability to customize graphics on shoes as well as other articles of clothing has become increasingly more important.

DISCLOSURE OF INVENTION

The platen comprises a shoe plate and adjustment means for keeping the shoe taut and flat on the shoe plate with various adjusters that allow shoes and other articles to be printed on it customized fashion.

BEST MODE FOR CARRYING OUT THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

The system for printing customized graphics on shoes and other articles utilizes a uniquely designed platen to accommodate various shoe types, caps, shirts, and other articles.

Figure 1:
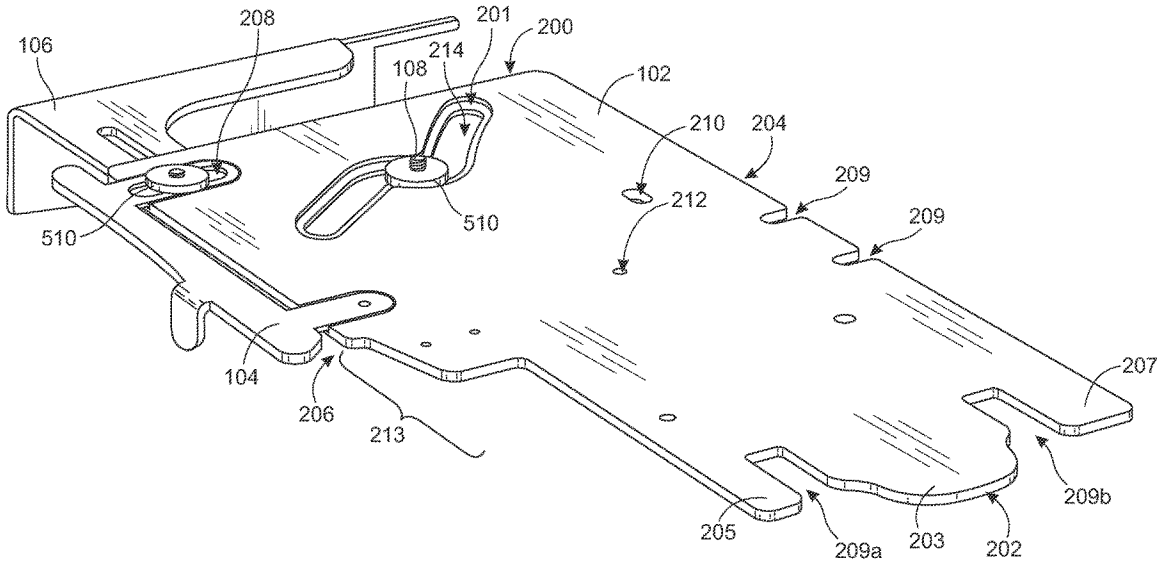
FIG. 1 is a top perspective view of an embodiment of a shoe platen.
Figure 2:
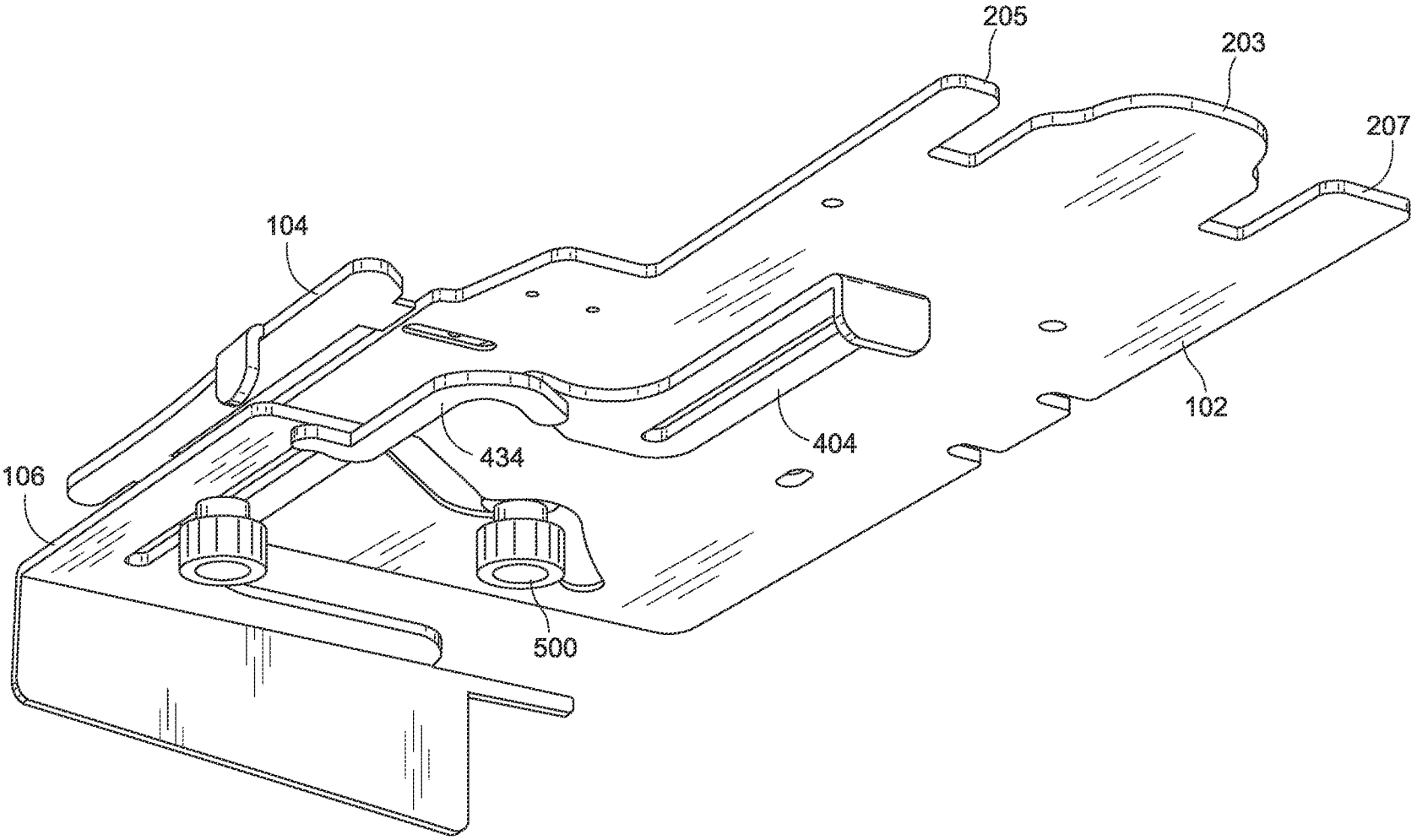
FIG. 2 is a bottom perspective view platen in FIG. 1.
Figure 3:
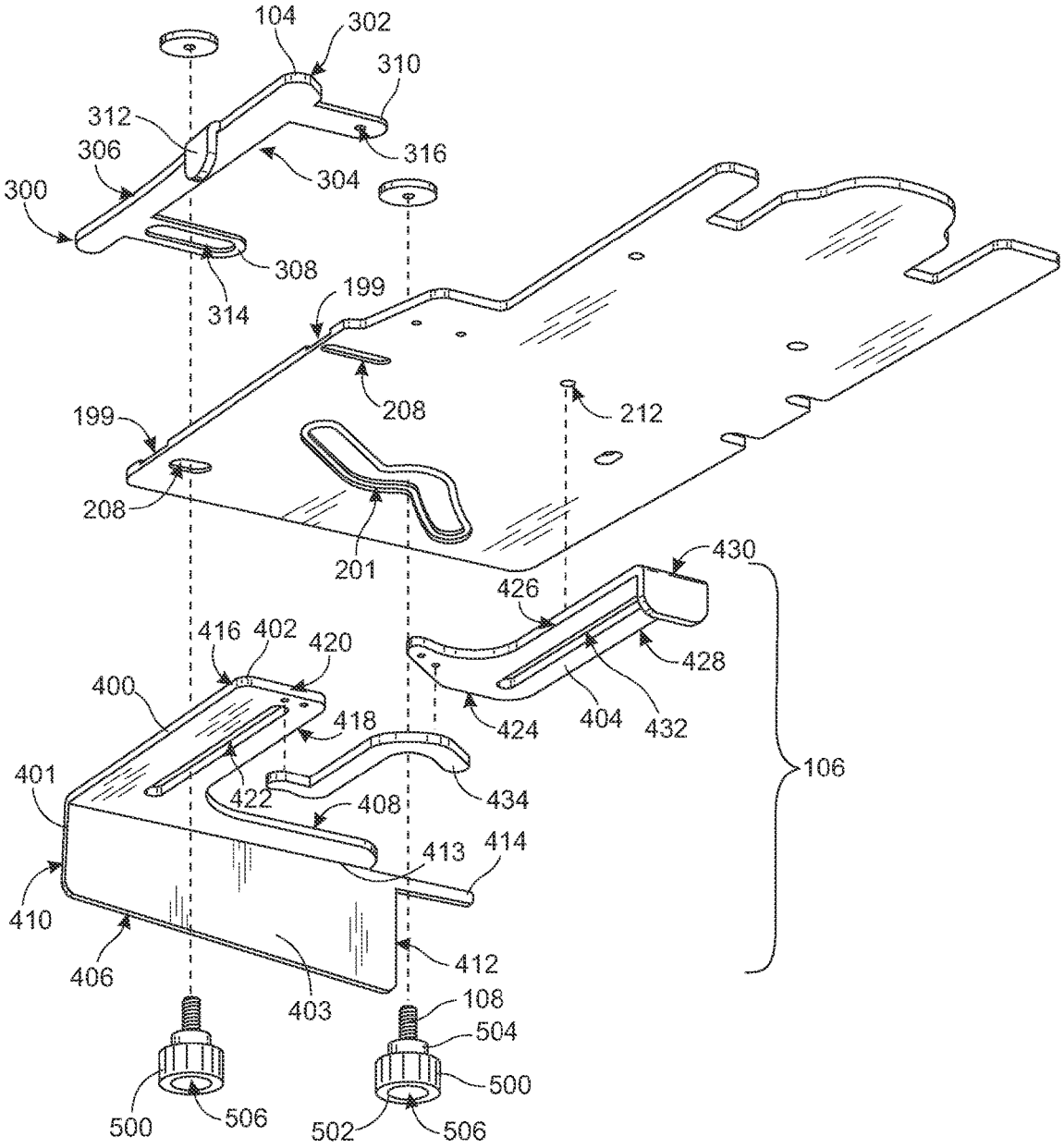
FIG. 3 is an exploded view of the platen in FIG. 1.
Figure 4:
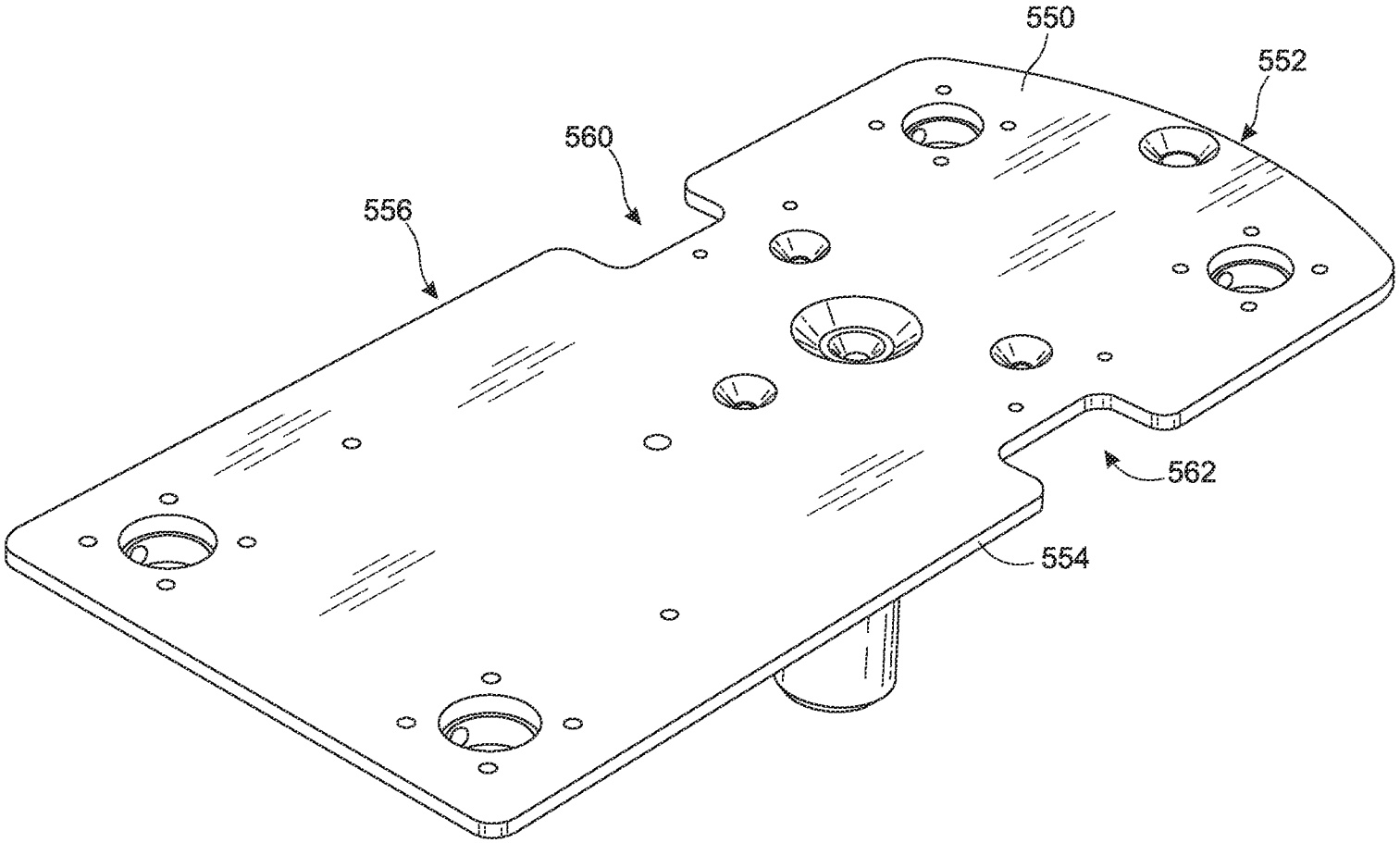
FIG. 4 is a top perspective view of an embodiment of the main plate.
Figure 5:
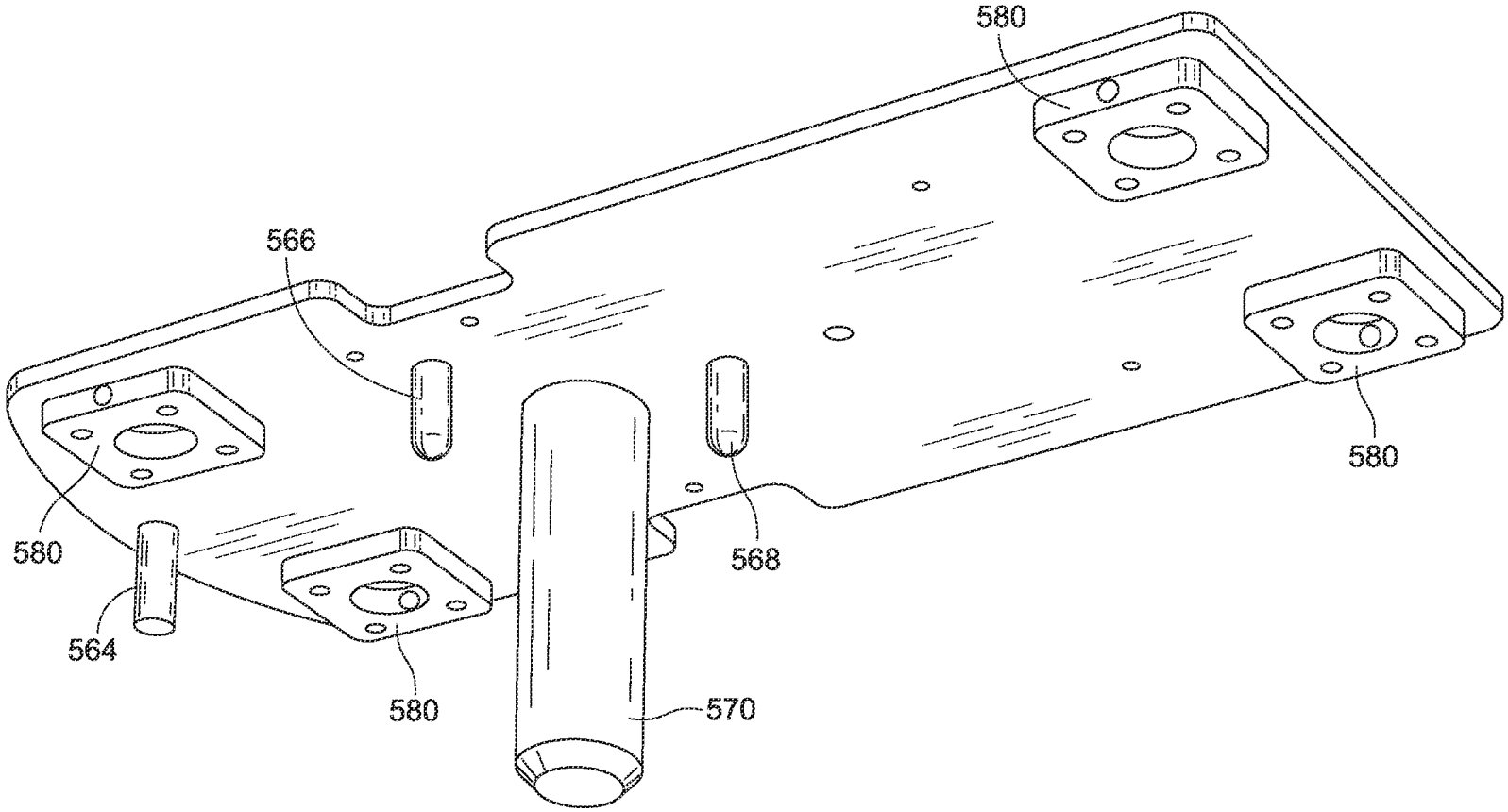
FIG. 5 is a bottom perspective view of the embodiment of FIG. 4.

In a first embodiment designed for high-top shoes, such as those made by Converse®, the platen comprises a shoe plate 102, a shoe adjuster 104, a slider bracket 106, and a fixing peg 108 as shown in FIGS. 1-3. The unique design of the shoe platen allows the use of a single platen for printing graphics on the tongue of the shoe and the sides of the shoe.

The purpose of the shoe plate 102 is to provide support for a shoe. In the preferred embodiment, the shoe plate 102 is generally rectangular in shape having a back edge 200, a front edge 202 opposite the back edge 200, a medial edge 204 adjacent to the back edge 200 and front edge 202, and a lateral edge 206 opposite the medial edge 204 and adjacent to the back edge 200 and the front edge 202. The shoe plate 102 may further comprise a plurality of slots 208, holes 210 and/or cutouts 209, and any combination thereof to for connecting the shoe plate to other components of the platen and accessory devices for printing. In the preferred embodiment, the front edge 202 is contoured.

For printing graphics on the side of the shoe, the shoe is mounted on the shoe plate 102 at its lateral edge 206, with the back or heel of the shoe adjacent to the back edge 200 of the shoe plate 200, the front of the shoe adjacent to the front edge 202 of the shoe plate 200, and the lateral edge 206 of the shoe plate 200 positioned inside the shoe adjacent to the upper cushioning. Generally, as shoes come in pairs, two shoe plates 102 that are mirror images of each other (in other words, the second shoe plate comprises all of the same features discussed herein for this embodiment except that it is a mirror image) can be aligned at their medial edges 204 so as to mount both shoes simultaneously. This allows two shoes to be printed on at the same time.

The front edge 202 of the shoe plate 200 is contoured to allow the tongue of the shoe to be placed on the top of the shoe plate 200, while the rest of the shoe is positioned underneath the shoe plate 200. Preferably, at the front edge 202 of the shoe plate 200 there are two slots 209*a*, 209*b* arranged bilaterally relative to the center of the front edge 202, one slot 209*a* positioned adjacent to the lateral edge 206 of the shoe plate 200 and a second slot 209*b* positioned adjacent to the medial edge 204 of the shoe plate 200. This creates a front edge 202 area having a base 203 in the middle and two bilateral side arms 205, 207, the side arms 205, 207 being separated from the base 203 by the slots 209*a*, 209*b*. Therefore, the front edge area 202 has generally an "M"-shaped appearance when viewed from the top.

Adjacent to the back edge 200 is a "Z"-shaped slot 214. A fixing peg 108 protrudes out from the "Z"-shaped slot 214 onto which an eyelet of the shoe can be inserted. For example, the top eyelet of the shoe may be inserted onto the fixing peg 108 to secure the top portion or mouth of the shoe.

In the preferred embodiment, generally around the middle area between the back edge 200 and front edge 202 the lateral edge 206 has an inward deviation 213, caused by the lateral edge 206 tapering, stepping in, or combination of both, to create space for the top of the front portion of the shoe to fit while the back half of the lateral edge 206 is being placed inside the shoe. The general approximation of the middle area is due to the fact that shoes come in various sizes. Since the purpose of the inward deviation 213 is to create clearance for the top of the front portion of the shoe, the precise location of the inward deviation 213 can vary, but generally placing it around the middle area may be sufficient. Preferably, the inward deviation should be slightly closer to the front edge 202 rather than the back edge 200 of the shoe plate 200.

The purpose of the bottom shoe adjuster 104 is to laterally adjust the shoe for proper positioning. The bottom shoe adjuster 104 is generally an elongated member having a back end 300, a front end 302 opposite the back end 300, a medial side 304 adjacent to the back end 300 and front end 302, a lateral side 306 opposite the medial side 304 and adjacent to the back end 300 and front end 302, and a plurality of projecting members 308, 310 projecting perpendicularly and medially from the medial side 304. In some embodiments, the shoe adjuster may have a tab 312 projecting perpendicularly and downwardly from the lateral side 306.

In the preferred embodiment, the medial side 304 has a rear medially-projecting member 308 and a forward medially-projecting member 310, and the lateral side has a downwardly-projecting member 312. The medially-projecting members 308, 310 may comprise slots 314 and/or holes 316 to provide a means for securing the adjuster 104 to the shoe plate 102 in a slidable fashion. The shoe plate 200 may have recessed surface 201 corresponding in shape and location with the medially projecting members 308, 310 to provide a means for allowing the medially projecting members 308, 310 to slide medially and laterally relative to the shoe plate 200. The adjuster 104 is connected to the shoe plate 102 by abutting or aligning the medial side 304 of the adjuster 104 with the lateral side 206 of the shoe plate 102 and fastening the medially-projecting members 308, 310 of the adjuster 104 to a corresponding slot 208 or orifice on the shoe plate 102. Due to the slots 208 the adjuster 104 can be adjusted in a medio-lateral direction relative to the shoe plate 102.

The tab 312 may be positioned at the lateral side 306 of the shoe adjuster 104. Because the tab 312 projects perpendicularly downward, its surface is parallel with the insole of the shoe. Therefore, the tab 312 abuts the insole of the shoe to impart a biasing force against the insole of the shoe. In conjunction with the securement of an eyelet of the shoe by the fixing member 108, the fixing member 108 and the tab 312 keep the shoe taut and flat for printing on the side of the shoe. In some embodiments, the tab 312 may extend a partial length of the adjuster 104. In some embodiments, the tab 312 may extend the full length (from the front end 300 to the backend 302) of the adjuster 104. In some embodiments, a plurality of short tabs 312 may be intermittently spaced along the length of the adjuster 104. These variations may improve the stability of the shoe as an increased surface area is created to contact the insole of the shoe.

The slider bracket 106 imparts a biasing force against the heel of the shoe. In the preferred embodiment, the slider bracket 106 is generally a "G"-shaped bracket. The slider bracket comprises a slide bar 400 attached to a connector 434, which in turn is connected to a stabilizer bar 404. The slide bar 400 has a general "L"-shape configuration having a generally rectangular shaped heel base 401 that bends perpendicularly to a sliding stem 402. The heel base comprises a back edge 406, a front edge 408 opposite the back edge 406, a lateral edge 410 adjacent to the back edge 406, and a medial edge 412 opposite the lateral edge 410 and adjacent to the back edge 406. Projecting perpendicularly and medially from the medial edge 412 and adjacent to the front edge 408 is a medial member 414. The slide bar 400 is bent downward approximately 90° along a line 413 parallel to and in between the front edge 408 and the medial member 414 to provide a surface that abuts the heel of the shoe. Therefore, a second tab 403 is created by the bend in the slide bar 400 along line 413 that is parallel to and in between the front edge 408 and medial member 414. The medial member 414 provides added support against the heel for high-top like shoes.

The sliding stem 402 projects perpendicularly away from the lateral edge 410 of the heel base generally in the direction of the stabilizer bar 404 to create the "L" configuration of the slide bar 400. The sliding stem 402 has an elongated lateral side 416 and an elongated medial side 418 and a front edge 420. The sliding stem 402 comprises an elongated slot 422 parallel to the lateral side 410 and medial side 418 to allow the slider bracket 106 to be slidably fastened to the shoe plate 102.

The stabilizer bar 404 is generally rectangular in shape having a back edge 424, elongated lateral 426 and medial 428 side edges adjacent to the back edge, and a front edge 430 opposite the back edge 424 and adjacent to the lateral edge 426 and medial edge 428. The stabilizer bar 404 comprises an elongated slot 432 parallel to the medial 428 and lateral 426 side edges through which the stabilizer bar 404 can be connected to the shoe plate 102.

A connector 434 connects the front edge 420 of the sliding stem 402 to the lateral edge 426 of the stabilizer bar 404 near the back edge 424 of the stabilizer bar. The connector 434 is generally in the shape of a "J" or "Z" thereby medially off-setting the stabilizer bar 404 relative to the sliding stem 402. This provides added leverage to the slider bracket 106 as it pushes against the heel of the shoe.

The slider bracket 106 connects to the shoe plate 102 through the elongated slot 422 of the slider bracket 106. In some embodiments, the slider bracket 106 may further connect with the adjuster 104 through the shoe plate 102. For example, as shown in FIG. 3, a fastener may be inserted through the elongated slot 422 of the sliding stem 402, through the hole 208 of the shoe plate 102, and through the slot 314 on the upper medially-projecting member 308. A fixing pin is inserted through the elongated slot 432 of the stabilizer bar 404 of the slider bracket 106 and through the central hole 212 of the shoe plate 102. The slider bracket 106 connects to the shoe plate 102 in a sliding fashion so as to be slidable in a front to backward direction such that the second tab and medial member 414 of the slider bracket 106 can buttress against the back edge 200 of the shoe plate 102 in a first configuration, or be positioned away from the back edge 200 of the shoe plate 102 in a rearward direction in a second configuration. With one of the eyelets of the shoe secured to the fixing peg, positioning the slider bracket 106 in the second configuration further adds to the tautness of the shoe, thereby providing a secure attachment and a flat surface to print on.

The fastener can be any type of fastener, such as a nut and bolt, dowels, pegs, and any other fastener that allows the structures to slide. In some embodiments, the fastener may be a T-knot 500. The T-knot 500 allows the elements to connect together in a slidable fashion. In the preferred embodiment, the T-knot 500 has a circular base 502 with an oval intermediate portion 504, and a hole 506 through the center of the oval intermediate portion 504. The fixing pin 108 may be fixed inside the hole 506. The T-knot 500 essentially clamps one of the components to another, while permitting a sliding action when loosened. The edges of the shoe plate 200 defining the slot 214 may be slightly recessed into the top and bottom surfaces of the shoe plate 200 to facilitate the sliding action of the circular base 500 and washer 510 along the slot 214. In the preferred embodiment, a washer 510 may be seated in the top recessed surface 199 and the oval intermediate portion 504 may be seated in the recessed surface 201. The washer 510 and fixing pin 108 may be threaded (like a nut and bolt) so that the fixing pin 108 can be screwed into the washer 510 to fix the fixing pin 108 in position when screwed tight while permitting a sliding action when loosened.

Once the shoe platen is assembled, it can be mounted onto a main plate. The main plate is a type of adapter that allows various platens to mount onto the receiver of a printer. Therefore, the top surface of the main plate comprises a means for quickly and easily attaching to a platen, and the bottom surface of the main plate comprises a means for quickly and easily attaching to the printing device.

In the preferred embodiment, the main plate 550 is generally rectangular in shape having a rounded back 552 and, two side edges 554, 556, and a front end 558. The main plate 550 may have a means for ensuring the proper orientation of the platen. For example, the two side edges may comprise a rectangular slot 560, 562 to fit the main plate to the printing device. On the bottom surface of the main plate, a plurality of projecting members 564, 566, 568, 570 may extend away from the bottom surface. One of the projecting members 570 may be to secure the main plate 550 to the printing device, the other projecting members 564, 566, 568 also secure the main plate 550 to the printing device as well as fixing the orientation.

To fix the platen to the main plate 550, the main plate 550 may comprise a securing peg or bolt that protrudes out from the top surface. This peg or bolt is designed to fit into a corresponding hole in a platen. To further assist in mounting the platen onto the main plate, the main plate may comprise magnets 580. Preferably, the magnets 580 are positioned at the four corners of the main plate 550; however, the magnets 580 can be positioned almost anywhere. The shoe platen has corresponding pieces of metal or magnets for attaching to the magnets 580 on the main plate 550 in the proper orientation.

In use, the lateral edge 206 of the shoe plate 102, with the shoe adjuster 104 and slider bracket 106 attached is inserted into the mouth of the shoe, such as a Converse® hightop, with the shoe adjuster 104 abutting the insole of the shoe and the slider bracket 106 abutting the back of the upper from the inside of the shoe. The shoelace eyelet at the top of the shoe is inserted onto a slidable fixing peg 108 protruding out from the "Z"-shaped slot 214. Other shoelace eyelets can be mounted on other fixed pegs on the shoe plate 102. The shoe adjuster 104, the slider bracket 106, and the fixing peg protruding out from the "Z"-shaped slot are adjusted and secured so as to make the side surface of the shoe taut and flat against the shoe plate 102.

The shoe plate 102 can be mounted onto a main plate for printing by a printing device. The printing device receives instruction from a computer regarding the graphic image to print on to the shoe. Software can be developed so that characteristics of a shoe can be inputted, such as size, type, orientation, and the like, and a particular graphic uploaded, so that execution of the program will allow the graphic to be printed on to the shoe as desired. The printing device can be an ink jet printing device that can print on fabric, such as those sold by Brother.

This process can be reversed so as to print graphics on to the other side of the shoe. The tongue of the shoe can also be printed upon using the same shoe plate 102. The front edge 202 can be inserted into the mouth of the shoe such that the tongue is on top of the shoe plate 102 with the rest of the upper underneath the shoe plate. This is made possible due to the contours of the front edge 202, specifically, the bilateral slots 220 and 222, which maximizes the amount of the tongue that can be printed upon. The tongue can be fastened to the top of the shoe plate through a variety of fasteners.

In another embodiment, designed for low top shoes with a relatively fixed tongue or low top shoes without the need for shoelaces, such as Vans®, the shoe platen comprises a shoe plate 602, a rod guide 604, and a mac plate 606. In one embodiment, the shoe plate 602 has generally an "M"-shape configuration, having a back edge 700, two lateral edges 704, 706 and a front edge 702. From the front edge 702 projects two bilaterally arranged elongated members 708, 710 and a central plate 712 in between the bilateral members 708, 710. The shoe plate 602 further comprises a plurality of through-holes 714 through which other pieces can be fastened. Near the center of the central plate 712 is a bulb-shaped through-hole to receive the main plate.

Grooved into the shoe plate 602 is a pair of channels 720, 722 angled toward each other as the channels 720, 722 move towards the back edge 700. A pair of channels 720, 722 is positioned directly behind each bilateral member 708, 710. Each bilateral member 708, 710 comprises horizontal through holes at the front end end. A flexible and elastic rod can be inserted into the through hole and the free ends of the rod are inserted into each channel 720, 722. The rod is secured inside channel with the rod guide 604. This creates an oval shaped tension member creating a horizontally displaced biasing force. The tension member can be inserted into the mouth of a shoe. Due to the tension created by the rod being in a bent configuration, the tension member spreads the top of the shoe creating a flat surface on the top of the shoe upon which graphics can be printed.

The rod guide 604 keeps the flexible, elastic rods secured on the shoe plate 602. The rod guide 604 is generally a "V"-shaped structure with a plurality of holes 800 through which the rod guide 604 can be fastened to the shoe plate 602. The rod guide has a divergent end 802 and a convergent end 804. One rode guide 604 is fastened to the shoe plate 602 directly in front of each elongated member 708, 710 of the shoe plate 602 with the divergent end 802 facing the elongated members 708, 710. Although the rod guide 604 is shaped to match the channels 720, 722 the rod guide can be any shape that prevents the rods from falling off of the shoe plate 602. For example, the rod guide 604 can be square, rectangular, triangular, circular, and the like.

The function of the mac plate 606 is to provide a quick and easy means for the shoe plate 602 to connect to the main plate. The mac plate 606 is essentially a piece of metal or a magnet that corresponds to a magnet on the main plate. The mac plate 606 is generally rectangular or square in shape with a plurality of holes 900 through which it can be fastened to the shoe plate 602. Preferably, the mac plate 606 is fastened to the shoe plate 602 bilaterally adjacent the front edge 702 of the central plate 712 and bilaterally adjacent the back edge 700 of the shoe plate 602.

Figure 6:
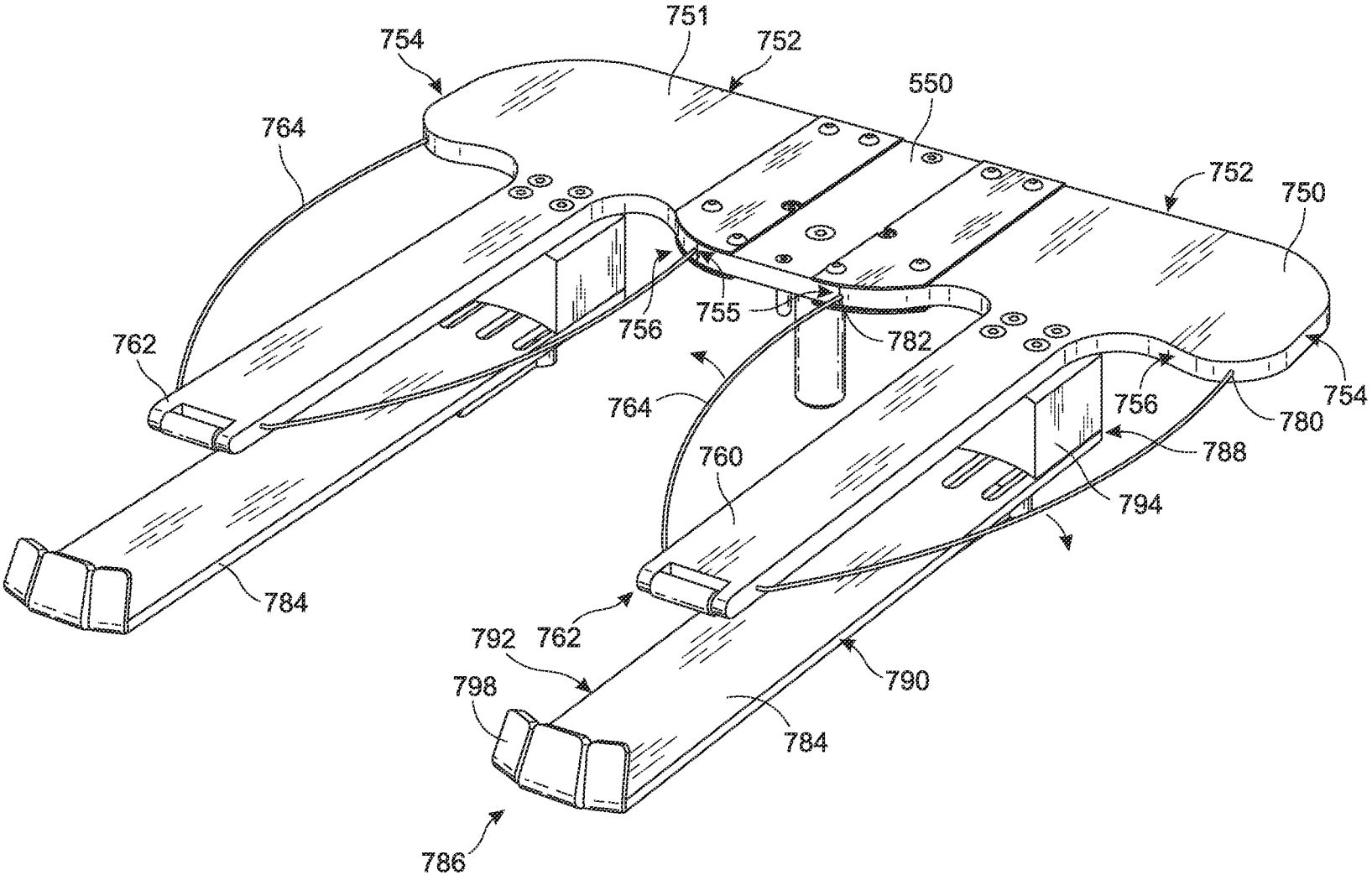
FIG. 6 is a top perspective view of another embodiment of a shoe platen.
Figure 7:
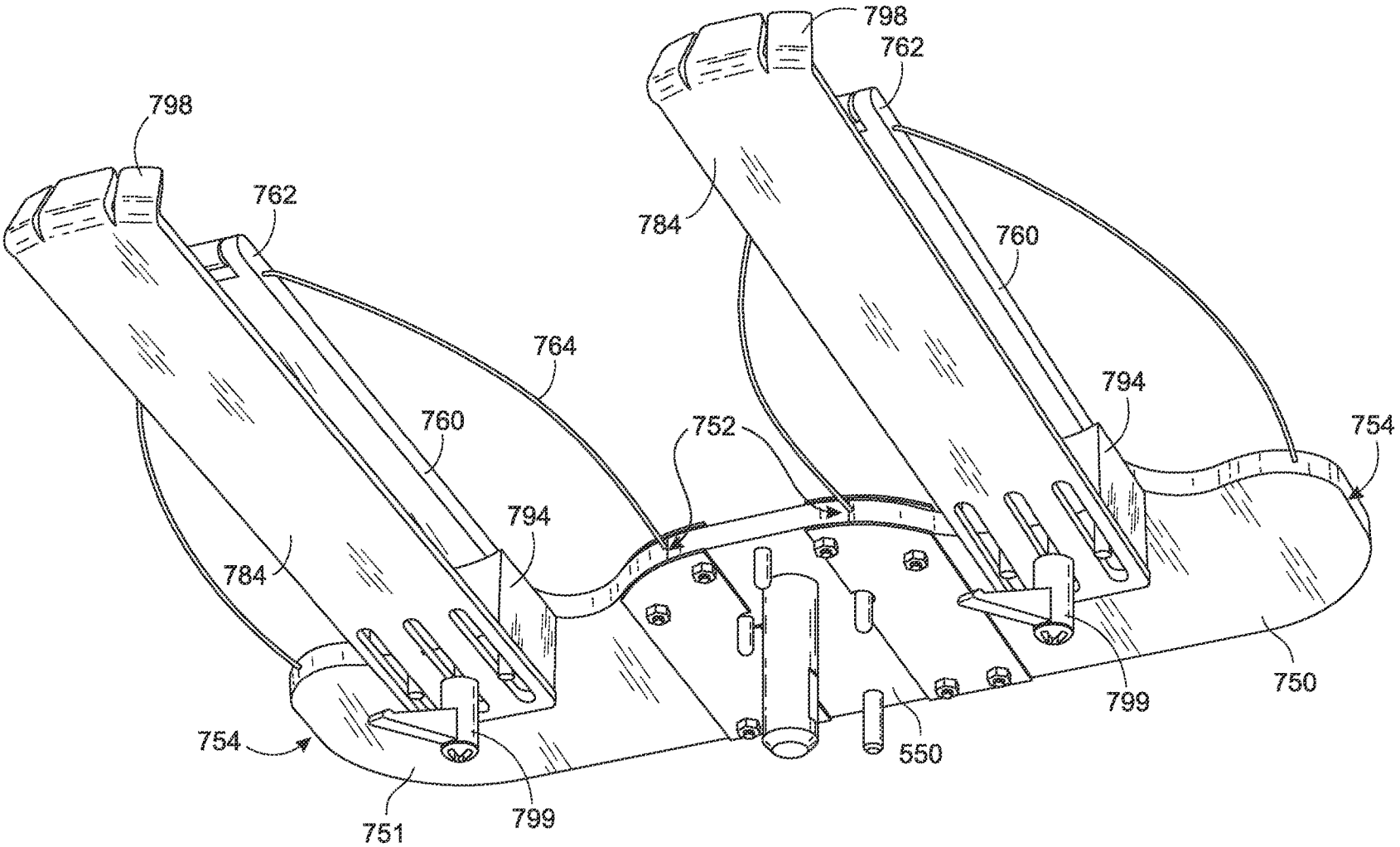
FIG. 7 is a bottom perspective view of the embodiment in FIG. 6.
Figure 8:
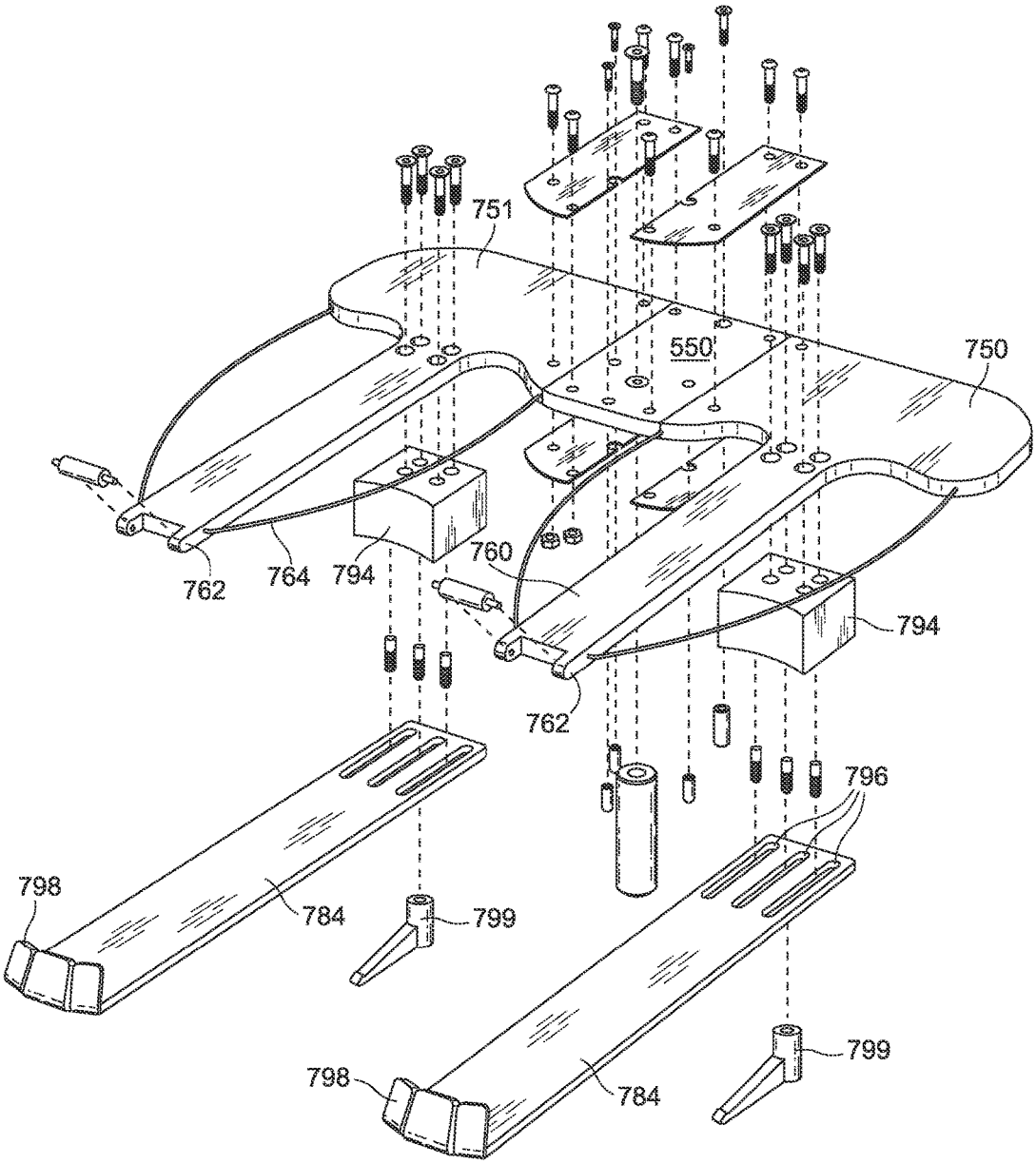
FIG. 8 is an exploded view of the embodiment in FIG. 6.

In another embodiment for low-top shoes without laces, as shown in FIGS. 6-8, a shoe plate 750 may have generally a "T" shape configuration, having a back edge 752, a lateral edge 754 adjacent to the back edge, a medial edge 755 opposite the lateral edge 754 and adjacent to the back edge 752, and a front edge 756 opposite the back edge 752 and adjacent to the lateral edge 754. Extending perpendicularly from the front edge 756 away from the back edge 752 is an elongated member 760 terminating at a free end 762.

The elongated member 760 comprises a biasing mechanism 764 that creates a biasing force bilaterally away from the elongated member 760 as shown by the arrows. For example, the elongated member 760 may have a spring-like rod having a middle portion of the rod attached to the free end 762 of the elongated member 760, and free ends 780, 782 of the rod arched back and connected to the front edge 756 of the shoe plate 750 or the back portion of the elongated member 760 itself. In a preferred embodiment, the free end 762 of the elongated member 760 has a transverse through hole. A flexible rod 764 can be inserted into the through hole and the free ends 780, 782 of the rod 764 can be inserted into holes on the front edge 756 of the shoe plate 750 that are positioned bilaterally relative to the elongated member 760. The arch created in the flexible rod creates a biasing force away from the elongated member. Therefore, when the elongated member 760 and flexible rod 754 are inserted into the mouth of the shoe, the tension created in the flexible rod from being in a bent configuration pushes against the sides of the shoe from the inside creating a flat top surface and fixing the shoe in place due to the resistance created by the flexible rods against the inside of the shoe.

In some embodiments, to further stabilize the shoe, below each elongated member may be a support panel 784 for the sole of the shoe to rest upon. The support panels 784 are generally a rectangular configuration having a front end 786, a back end 788 opposite the front end 784, and two elongated sides 790, 792 opposite each other and attaching the front end 786 and the back end 788. The back end 788 may be attached to the shoe plate 750 via a connector block 794. Preferably, the back end 788 is connected to the connector block 794 via at least one elongated slot 796 with a fastener 799. The elongated slot 796 may be parallel to the two sides 790, 792. This allows the support panels 784 to slide in a forward and backward direction to accommodate shoes of different sizes.

In the preferred embodiment, the front end 786 of the support panel 784 may be bent upward so as to create a wall 798. The toe cap of the shoe can be buttressed against the wall 798 to provide further stability and security and minimize movement during the printing process.

In some embodiments, two shoe plates 750, 751 that are mirror images of each other, thereby having the exact same components, i.e. back edge, front edge, lateral edge, medial edge and elongated member, and biasing mechanism in the same arrangement, may be connected to each other at their medial edges 755, thereby forming a "π"-shape (pi-shape) configuration. In some embodiments, the connection may be via a main plate 550. In some embodiments, two shoe plates 750, 751 and the main plate 550 may be integrally formed as a single piece with the main plate 550 in between the two shoe plates 750, 751.

Like the first embodiment, once the shoe is mounted on the shoe plate 602, and the shoe plate 602 is mounted on the main plate, a computer software program can be utilized to operate a printing device to print graphics on to the shoe.

In another embodiment, a platen 1000 is designed to hold oversized shirts. The shirt platen 1000 comprises a large foundational plate 1002, base plate 1004, plastic bushing 1006, bottom bearing 1008, small machine guide 1010, magnetic bracket 1012, magnetic receiver 1014, original base plate 1016, and a top bearing 1018.

The purpose of the foundational plate 1002 is to provide a flat surface for a shirt. The large foundation plate is generally rectangular in shape having a front edge 1100, two side edges 1102, 1104, and a back edge 1106. In the preferred embodiment, the front edge 1100 tapers gradually to a point 1108. The large foundation plate 1002 further comprises a plurality of holes 1110 so that other components can be fastened to the large foundation plate 1002.

The base plate 1004 serves as the adapter to connect the foundational plate 1002 to the printer device. In the preferred embodiment, the foundational plate 1002 connected to the base plate 1004 with a rail system so as to allow the foundational plate 1002 to slide relative to the base plate 1004. This sliding action distinguishes the shirt platen of the present invention from other platens that allow shirts to be printed upon. Due to the sliding action, shirts or larger sizes than normal can be printed upon.

In the preferred embodiment, the base plate is generally "H"-shaped, having a front end 1200, two side edges 1202, 1204, and a back end 1206. From the bottom surface of the base plate a plurality projection members protrude out. These projection members are used to connect the base plate to the printing device.

The front and back ends 1200, 1206 have a "W" or "M"-like configuration characterized by two bilateral side arms 1208, 1210 and a central member 1212, 1204. The side arms 1208, 1210 are partially defined by the side edges 1202, 1214. The central member 1212 of the front end 1200 projects from the middle towards the front end 1200 and terminates with a rounded tip. The central member 1214 of the back end 1206 projects from the middle towards the back end 1206, tapers gradually, and terminates with a rounded tip. The base plate 1004 comprises a plurality of holes 1216 so that other components can be fastened to the base plate 1004. A plurality of holes 1216 are also found on the bilateral side arms 1208, 1210 and the central members 1212, 1214. The central member 1214 at the back end 1206 further comprises a larger square or rectangular void 1218. The mid-portion 1220 of the base plate 1004 also comprises contoured voids 1222.

The plastic bushing 1006, bottom bearing 1008, magnetic bracket 1012, and magnetic receiver 1014 are assembled together to form the rail system that allows the base plate 1004 to slidably attached to the foundational plate 1002. This rail system may be similar to a standard desk drawer slide rail system.

The plastic bushing 1006 is generally rectangular in shape with a plurality of holes 1300 aligned along the longitudinal center 1302 of the plastic bushing 1006. The front half 1304 and the back half 1306 are mirror images.

Two plastic bushings 1006 are fastened to the large foundational plate 1002 bilaterally relative to the longitudinal center, 1112 of the foundational plate 1002 adjacent the side edges 1102, 1104.

The bottom bearing 1008 is generally rectangular in shape with a plurality of holes 1400 along its longitudinal center line 1402 with two holes **1400*a*, 1400*b* closely positioned together (relative to the other holes) at the front end 1404**.

Two bottom bearings 1008 are fastened to the large foundational plate 1002 bilaterally relative to the longitudinal center 1112 of the foundational plate 1002, adjacent the side edges 1102, 1104 and in line with the plastic bushings 1006.

The small machine guide 1010 is generally "T"-shaped, formed by a lateral member 1500 and a stem 1502. The lateral member 1500 forms the top of the "T" and the stem 1502 forms the descending portion of the "T." The small machine guide 1010 further comprises a plurality of holes 1504 and at least one slot 1506. The slot 1506 is located along the longitudinal member 1502 with its longitudinal axis 1508 parallel and in line with the longitudinal center 1112 of the foundational plate 1002 when attached. The holes 1504 provide a means for fastening the small machine guide 1010 to the foundational plate 1002. The slot 1506 allows the small machine guide 1010 to slide or move relative to the foundational plate 1002.

The small machine guide 1010 is fastened to the foundational plate 1002 across the back 1206 and middle portion 1220 of the base plate 1004 with lateral member 1500 across the central member 1214 of the base plate 1004 and the longitudinal member 1502 extending into the mid-portion 1220 of the base plate 1004.

The magnetic bracket 1012 is generally rectangular in shape with a plurality of holes 1600 in line with the longitudinal axis 1602. In the preferred embodiment, two holes are positioned on one half of the magnetic bracket 1012 and one hole is positioned on the opposite half of the magnetic bracket 1012.

One magnetic bracket 1012 may be fastened at each of the front end 1100 and the back end 1106 of the large foundational plate 1002.

The magnetic receiver 1014 is generally rectangular in shape with a plurality of holes 1700 aligned along the longitudinal axis 1702. In the preferred embodiment two holes are positioned on one-half of the magnetic receiver 1014.

The original base plate 1016 is generally circular in shape with a plurality of holes 1800. The holes 1800 correspond with some of the holes on the mid-portion 1220 of the base plate 1004 so as to fasten the original base plate 1016 to the base plate 1004.

The top bearing 1018 is generally rectangular in shape with a plurality of holes 1900 lined along its longitudinal axis 1902. At one end of the top bearing 1018 is a cluster of three holes 1900*a*, 1900*b*, 1900*c*. Two top bearings 1018 are position bilaterally relative to the longitudinal axis 1112 of the large foundational plate 1002 at the back half 1106 of the large foundational plate 1002 and in line with the bottom bearing 1008.

In use, a shirt is pulled over the large foundational plate 1002. Clips are used to fasten the shirt flat and taut against the foundational plate 1002. The foundational plate assembled with the main plate is placed on the printer device based on the computer program set up the graphics can be printed onto the shirt.

Figure 9:
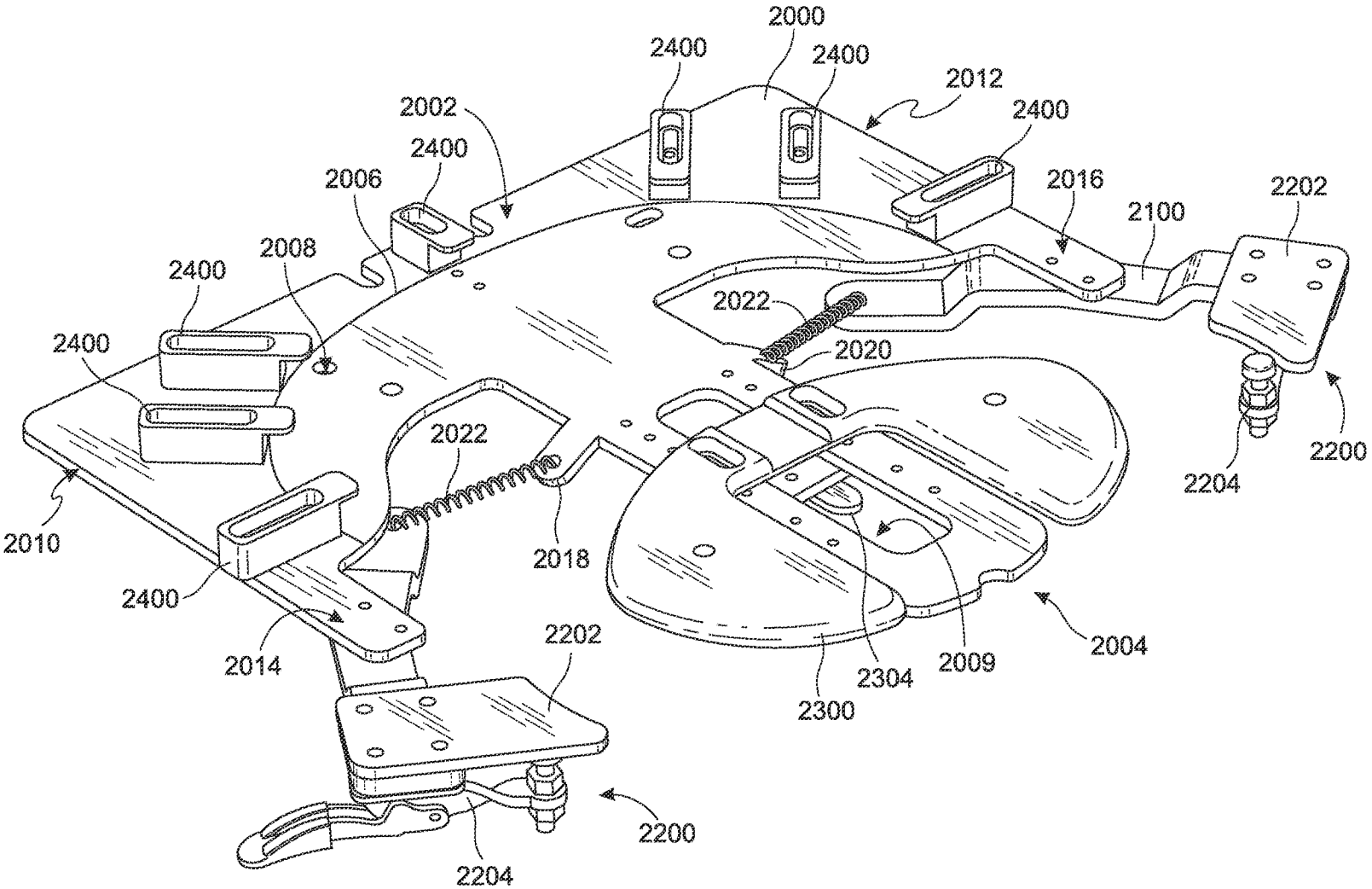
FIG. 9 is a top perspective view of an embodiment of a cap platen.
Figure 10:
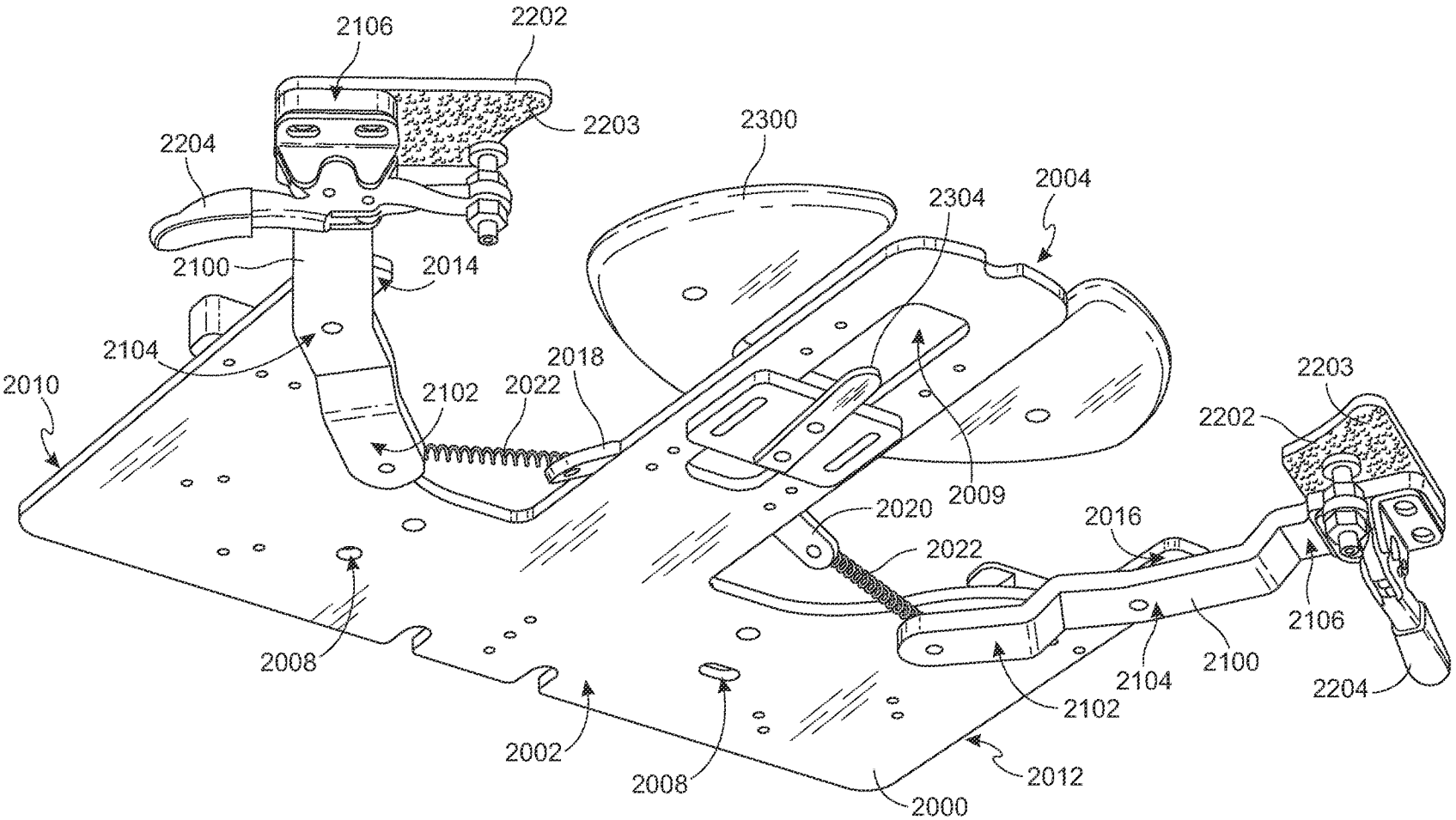
FIG. 10 is a bottom view of the cap platen in FIG. 9.

In another embodiment, as shown in FIGS. 9-141, a platen is configured to receive caps or hats. In the preferred embodiment, the cap platen comprises a vise plate 2000, a pair of arms 2100, a pair of clamps 2200, a face plate 2300, and a plurality of stoppers 2400.

The vise plate provides the main support for the cap. In the preferred embodiment, the vise plate has a "T"-shaped configuration, comprising a bill receiving end 2002 defined by the horizontal portion of the "T" terminating at terminal ends 2010 and 2012, and the crown receiving end 2004 defined by the stem of the "T." The bill receiving end 2002 may comprise a bill line 2006 as a guide for the proper placement of the bill of a cap. The bill line 2006 may be printed on the bill receiving end 2002, engraved into the bill receiving end 2002, and/or a protrusion rising up from the bill receiving end 2002. Throughout the vise plate 2000 are a plurality of holes 2008 or slots 2009 through which other components of the cap platen can be attached.

In some embodiments, the terminal ends 2010, 2012 of the bill receiving end 2002 each comprise extension members 2014, 2016 (or portions that extend from the terminal ends 2010, 2012) to which the arms 2100 can be attached. Along the crown receiving end 2004, two spring receiving members 2018, 2020 project perpendicularly away from the crown receiving end 2004. In some embodiments, the spring receiving members 2018, 2020 may also bend slightly downward so as to be displaced from the plane of the vise plate. The spring receiving members 2018, 2020 comprise holes to receive a spring 2022. The crown receiving end 2004 further comprises a slot 2009 to receive the face plate 2300.

Figure 11:
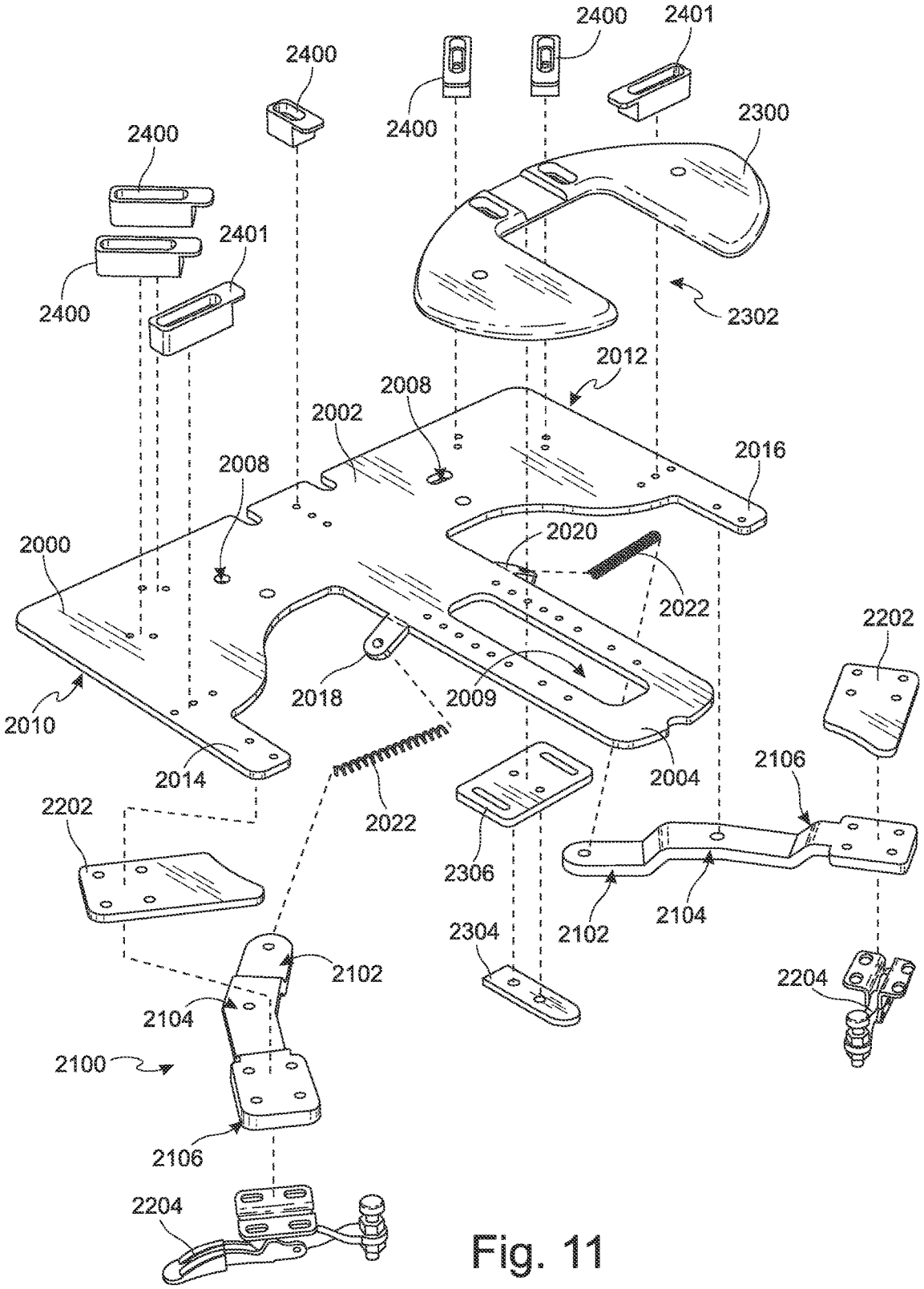
FIG. 11 is an exploded view the cap platen in FIG. 9.

Each extension member 2014, 2016 has attached to it an arm 2100. As shown in FIG. 11, the arm 2100 is rotatably attached to the extension member 2014 or 2016 so that the arms can move towards and away from the crown receiving end 2004. The arm 2100 comprises a plurality of holes strategically placed so as to attach to other components of the cap platen. In the preferred embodiment, the arm comprises a proximal end 2102, a distal end 2106 opposite the proximal end, and a middle portion 2104 in between the proximal end 2102 and the distal end 2106. In some embodiments, the distal end 2106 is displaced from the plane of the middle portion 2104 in one direction, and the proximal end 2102 is displaced from the plane of the middle portion 2104 in the opposite direction. This three level structure allows the proper components to align accordingly. In the preferred embodiment, it is the middle portion 2104 that is rotatably connected to the extension members 2014 or 2016. The proximal end 2102 is connected to the spring receiving member 2018 or 2020 by a spring element. Attached to the distal end 2106 is a clamp 2200.

The arm 2100, spring 2022, and clamp 2200 allows for the cap platen to pull on the sides of a cap to keep the cap taut. Springs 2022 can be attached to various other places on the cap platen, such as directly on the crown receiving end 2004, the bill receiving end 2002, the face plate 2300, the extension members 2104 or 2106, or even a structure separate from the cap platen. In some embodiments, the arms 2100 may be bilaterally positioned at opposite ends of the face plate 2300 or crown receiving end 2004 and configured to push the sides of the crown of the cap outwardly, for example by spring loading the arms against the faceplate 2300 or crown receiving end 2004. Thus, the user would push the arms 2100 inwardly towards the face plate 2300, place the crown of cap over the face plate 2300 and the arms 2100, and release the arms causing the arms to push outwardly against the side of the cap. By creating a biasing force to push or pull the sides of the cap away from the face plate, a flat printing surface can be created and movement of cap can be minimized.

In some embodiments, the clamp 2200 comprises and arm tooth 2202. The arm tooth 2202 may comprise a tooth portion 2203, which is essentially a rough surface that creates a high friction surface or a grip surface. In the preferred embodiment, the arm tooth 2202 is connected to the distal end 2106 of the arm 2100 in such a way that the tooth portion 2203 projects towards the crown receiving end 2004 of the vise plate 2000. A clamping device 2204 is attached to the distal end 2106 of the arm 2100 to provide a clamping action against the arm tooth 2202.

The face plate 2300 is a flat helmet shaped structure with a large cutout 2302 approximately at the center. The face plate 2300 is slidably attached to the crown receiving end of the vise plate 2000 so as to provide additional support for the crown of a cap. In some embodiments, the face plate 2300 may be reversibly fastened directly to the crown receiving end 2004, for example, with screws, magnets, hook and loop fasteners, and the like. In some embodiments, a bracket 2306 may be provided on the opposite side of the crown receiving end 2004. Fasteners, such as screws, bolts, and the like may be inserted through the face plate 2300 and connected to the bracket 2306 directly, or indirectly, via the crown receiving end 2004. Tightening the fasteners tightly sandwiches the face plate 2300 and the bracket 2306 against the crown receiving and 2004 to secure the faceplate to the crown receiving end 2004.

In some embodiments, attached to the crown receiving end 2004 opposite the face plate 2300 may be a clip 2304 two secure the loose back end of the cap. A remaining portion of the cap that is not secured can be shelved, tucked, or placed underneath the clip 2304, which secures the remaining portions of the cap against the crown receiving end 2004.

A plurality of stoppers 2400 are aligned along the bill line 2006 to help secure the bill of the cap. Essentially the bill of a cap is buttressed against the stopper 2400 so as to prevent forward and lateral movement. In some embodiments, the stopper 2400 may be biased against the vise plate 2000 so as to hold or clip the bill of a cap against the vise plate 2000 for added stability.

In use, a cap is positioned with its bill along the bill line 2006 and the inside of the crown on top of the face plate 2300. The bill can be pushed up against the stoppers 2400 and/or the stoppers 2400 can be adjusted to be pushed up against the bill. The face plate 2300 can be adjusted to abut the back of the bill where it interfaces with the crown so as to prevent backward movement. The arms 2100 can then be compressed towards the crown receiving end 2004 and the clamps can secure the sides of the crown against the arm teeth 2200. When the arms 2100 are released they will pull away from the crown receiving end 2004 due to the spring action. This will cause the cap to be pulled taut in the lateral direction. Finally, the back of the crown can be pulled away from the bill receiving end 2002 along the plane of the vise plate, then pulled under and secured to the clip underneath the face plate 2300 to assure that any loose portions of the cap are pulled taut. This creates a flat surface for the bill and the front portion of the crown to be printed on. The cap platen can then be attached to the main plate and loaded on to the printing device for printing. Again, computer software can be created to print graphics on the bill and the front of the crown.

In another embodiment, the platen can be configured to receive boots, such as the Ugg® boot. The boot platen has two arms separated by a spring. The two arms can be compressed and inserted into the mouth of the boot. Upon release the spring will force the two arms apart so as to make a surface of the boot taut and flat. The arms are connected to a main plate so as to be loaded on to a printer operated by a computer. Like the other embodiments, the computer is programmed to cause the printer to print a desired graphic onto the boot.

While the present invention has been described with regards to particular embodiments, it is recognized that additional variations of the present invention may be devised without departing from the inventive concept.

INDUSTRIAL APPLICABILITY

This invention may be industrially applied to the development, manufacture, and use of shoe platens for automatically printing graphics, including custom graphics, on a shoe, such as a high-top shoe or low top shoe. The platen comprises a shoe plate onto which a shoe can be mounted to be inserted into a printing device. The shoe plates come in a variety of configurations to fit shoes of different styles. Various accessory parts allow the shoe platen to adjust to shoes of different sizes.

What is claimed is:

1. A high-top shoe platen, comprising:

a. a shoe plate to provide support for a shoe, the shoe plate, comprising:
   i. a back edge,
   ii. a front edge opposite the back edge, the front edge having a contoured perimeter,
   iii. a medial edge adjacent to the back edge and front edge, and
   iv. a lateral edge opposite the medial edge and adjacent to the back edge and the front edge,
   v. a "Z"-shaped slot adjacent to the back edge,
   vi. a fixing peg protruding out from the "Z"-shaped slot and moveably attached to the shoe plate, the fixing peg configured to receive an eyelet of a shoe, wherein the lateral edge of the shoe plate has an inward deviation at approximately a middle area between the back edge and the front edge of the shoe plate, and b. a bottom shoe adjuster attached to the lateral edge of the shoe plate, the shoe adjuster having a back end, a front end opposite the back end, a medial side adjacent to the front end and back end, a lateral side opposite the medial side and adjacent to the front end and back end, at least one projecting member projecting perpendicularly and medially from the medial side, and at least one tab projecting perpendicularly and downwardly from the lateral side;

c. a slider bracket attached to the back edge of the shoe plate, the slider bracket having a generally "G"-shaped configuration, wherein the slider bracket comprises a slide bar, a connector attached to the slide bar, and a stabilizer bar attached to the connector, wherein the slide bar has a general "L"-shape configuration having a generally rectangular shaped heel base that bends perpendicularly to a sliding stem, wherein the heel base comprises a back edge, a front edge opposite the back edge, and a lateral edge adjacent to the back edge, and a medial edge opposite the lateral edge and adjacent to the back edge, wherein the slide bar is bent downward approximately 90° along a line parallel to and in between the front edge and the medial member of the heel base to form a second tab on the slide bar along the line parallel to and in between the front edge and medial member of the heel base, wherein the stabilizer bar is generally rectangular in shape having a back edge, an elongated lateral side adjacent to the back edge, an elongated medial side adjacent to the back edge and opposite the elongated lateral side, a front edge opposite the back edge and adjacent to the elongated lateral side and the elongated medial side of the stabilizer bar, an elongated slot parallel to and in between the medial side and lateral side of the stabilizer bar through which the stabilizer bar can be connected to the shoe plate, wherein the connector is generally "J"-shaped thereby medially off-setting the stabilizer bar relative to a sliding stem of the slide bar.

2. A shoe platen, comprising:

a. a shoe plate to provide support for a shoe, the shoe plate, comprising:

i. a back edge, ii. a front edge opposite the back edge, the front edge having a contoured perimeter, iii. a medial edge adjacent to the back edge and front edge, and iv. a lateral edge opposite the medial edge and adjacent to the back edge and the front edge, v. a "Z"-shaped slot adjacent to the back edge, vi. a fixing peg protruding out from the "Z"-shaped slot and moveably attached to the shoe plate, the fixing peg configured to receive an eyelet of a shoe, and b. a bottom shoe adjuster attached to the lateral edge of the shoe plate, the shoe adjuster having a back end, a front end opposite the back end, a medial side adjacent to the front end and back end, a lateral side opposite the medial side and adjacent to the front end and back end, at least one projecting member projecting perpendicularly and medially from the medial side, and at least one tab projecting perpendicularly and downwardly from the lateral side;

c. a slider bracket attached to the back edge of the shoe plate, the slider bracket having a generally "G"-shaped configuration.

3. The shoe platen of claim 2, wherein the lateral edge of the shoe plate has an inward deviation at approximately a middle area between the back edge and the front edge of the shoe plate.

4. The shoe platen of claim 2, wherein the medial side of the shoe adjuster has an upper medially-projecting member and a lower medially-projecting member, and the lateral side of the shoe adjuster has a downwardly-projecting member.

5. The shoe platen of claim 2, wherein the slider bracket comprises:

a. a slide bar, b. a connector attached to the slide bar, and c. a stabilizer bar attached to the connector.

6. The shoe platen of claim 5, wherein the slide bar has a general "L"-shape configuration having a generally rectangular shaped heel base that bends perpendicularly to a sliding stem, wherein the heel base comprises a back edge, a front edge opposite the back edge, a lateral edge adjacent to the back edge, and a medial edge opposite the lateral edge and adjacent to the back edge.

7. The shoe platen of claim 6, further comprising a medial member projecting perpendicularly and medially from the medial edge and adjacent to the front edge of the heel base.

8. The shoe platen of claim 5, wherein the slide bar is bent downward approximately 90° along a line parallel to and in between the front edge and the medial member to form a tab on the slide bar.

9. The shoe platen of claim 3, wherein the stabilizer bar is generally rectangular in shape having a. a back edge, b. an elongated lateral side adjacent to the back edge, c. an elongated medial side adjacent to the back edge and opposite the elongated lateral side, d. a front edge opposite the back edge and adjacent to the elongated lateral side and the elongated medial side of the stabilizer bar, e. an elongated slot parallel to and in between the medial side and lateral side of the stabilizer bar through which the stabilizer bar can be connected to the shoe plate.

10. The shoe platen of claim 3, wherein the connector is generally "J"-shaped thereby medially off-setting the stabilizer bar relative to a sliding stem of the slide bar.

11. The shoe platen of claim 3, further comprising a T-knot fastener fastenable within the "Z"-shaped slot.

12. A custom shoe printing system, comprising a shoe platen to provide support for a shoe, the shoe platen, comprising a shoe plate having:

a. a back edge, b. a front edge opposite the back edge, c. a medial edge adjacent to the back edge and front edge, and d. a lateral edge opposite the medial edge and adjacent to the back edge and the front edge, and e. a "Z"-shaped slot adjacent to the back edge.

13. The custom shoe printing system of claim 12, further comprising a fixing peg protruding out from the "Z"-shaped slot and moveably attached to the shoe plate, the fixing peg configured to receive an eyelet of the shoe.

14. The custom shoe printing system of claim 12 further comprising a bottom shoe adjuster attached to the lateral edge of the shoe plate, the bottom shoe adjuster configured to abut against an insole of the shoe to adjust the shoe in the lateral direction relative to the shoe plate.

15. The custom shoe printing system of claim 12, further comprising a slider bracket attached to the back edge of the shoe plate, the slider bracket having a generally "G"-shaped configuration and configured to adjust the shoe in a backward direction relative to the shoe plate.

16. The custom shoe printing system of claim 15, wherein the slider bracket comprises:

a. a slide bar, b. a connector attached to the slide bar, and c. a stabilizer bar attached to the connector.

17. The custom shoe printing system of claim 12, wherein the front edge is contoured to receive a tongue of the shoe.

18. The custom shoe printing system of claim 12, further comprising a main plate configured to receive the platen, the main plate further configured to mount onto a receiver of a printer.

19. The custom shoe printing system of claim 18, wherein the main plate is configured to receive two shoe platens.

20. The custom shoe printing system of claim 18, wherein the main plate comprises magnets to facilitate attachment to the shoe platen.

* * * * *